US009377704B2

(12) United States Patent
Farrugia et al.

(10) Patent No.: US 9,377,704 B2
(45) Date of Patent: Jun. 28, 2016

(54) RED TONERS

(71) Applicant: Xerox Corporation, Norwalk, CT (US)

(72) Inventors: Valerie M Farrugia, Oakville (CA); Jordan H Wosnick, Toronto (CA); Eric Rotberg, Toronto (CA); Karen A Moffat, Brantford (CA); Richard P N Veregin, Mississauga (CA); Suxia Yang, Mississauga (CA); C Geoffrey Allen, Waterdown (CA)

(73) Assignee: Xerox Corporation, Norwalk, CT (US)

( * ) Notice: Subject to any disclaimer, the term of this patent is extended or adjusted under 35 U.S.C. 154(b) by 103 days.

(21) Appl. No.: 13/667,979

(22) Filed: Nov. 2, 2012

(65) Prior Publication Data

US 2014/0127619 A1 May 8, 2014

(51) Int. Cl.

| | |
|---|---|
| ***G03G 9/09*** | (2006.01) |
| ***G03G 9/087*** | (2006.01) |
| ***G03G 9/08*** | (2006.01) |

(52) U.S. Cl.

CPC ..... *G03G 9/08711* (2013.01); *G03G 9/0804* (2013.01); *G03G 9/08706* (2013.01); *G03G 9/08708* (2013.01); *G03G 9/08728* (2013.01); *G03G 9/08731* (2013.01); *G03G 9/08733* (2013.01); *G03G 9/0914* (2013.01); *G03G 9/0926* (2013.01)

(58) Field of Classification Search

CPC ..... G03G 9/0906; G03G 9/08755; G03G 9/08722; G03G 15/5041; G03G 9/0926

USPC ..... 430/108.2, 108.23, 107.1, 108.9, 108.1, 430/108.21, 7

See application file for complete search history.

(56) References Cited

U.S. PATENT DOCUMENTS

| | | | | |
|---|---|---|---|---|
| 4,681,829 | A * | 7/1987 | Grushkin | 430/108.2 |
| 5,346,545 | A * | 9/1994 | Chassot | 106/410 |
| 5,607,804 | A * | 3/1997 | Bertrand et al. | 430/45.53 |
| 5,736,291 | A * | 4/1998 | Dalal et al. | 430/137.1 |
| 5,837,409 | A * | 11/1998 | Bertrand et al. | 430/45.4 |
| 6,066,422 | A * | 5/2000 | Blaszak et al. | 430/45.4 |
| 2007/0125263 | A1 * | 6/2007 | Weber et al. | 106/31.81 |
| 2009/0098477 | A1 * | 4/2009 | Carter et al. | 430/108.21 |
| 2011/0033793 | A1 * | 2/2011 | Chen et al. | 430/105 |

* cited by examiner

*Primary Examiner* — Stewart Fraser
*Assistant Examiner* — Olatunji Godo
(74) *Attorney, Agent, or Firm* — Marylou J. Lavoie, Esq. LLC

(57) ABSTRACT

Red toners that approximate PANTONE® Red 032 and PANTONE® Warm Red are described. The colorant includes an orange colorant and a red colorant, where the orange colorant absorbs light having a wavelength of from about 400 to about 520 nm, and where the red colorant absorbs light having a wavelength of from about 500 to 580 nm.

20 Claims, No Drawings

RED TONERS

FIELD

Red toner particles; developers comprising said red toner particles; devices comprising said red toner particles and developers; imaging device components comprising said toner particles and developers; imaging devices comprising said developers; and so on, with the toner particles providing colors approximating PANTONE® Red 032 and PANTONE® Warm Red, are described.

BACKGROUND

CMYK is a color model of the four colors, cyan, magenta, yellow and black. The CMYK model works by partially or entirely masking certain colors of a light or white background (that is, absorbing and scattering particular wavelengths of light). Thus, white is the natural color of the background while black results from a full combination of the colors. Deeper black tones and unsaturated and dark colors can be produced by substituting black for the combination of cyan, magenta and yellow. CMYK is an example of a model called, "subtractive," because colors subtract brightness and colors from a light or white background. Photocopies or prints, such as, a print on paper, are examples of display modes that are based on a subtractive color model as generally the image is presented on a lighter background, such as, white paper.

An alternative way to generate color is an additive model, such as, RGB (red, green and blue), wherein the combination of all colors produces white, and black is the absence of all light. CRT's, LCD's, televisions and so on are examples of display modes that are based on an additive color model as generally the image is presented on a darker surface.

The prevalent use of red colors makes red toners desirable, particularly the red colors found in the PANTONE® color space, Red 032 and Warm Red, which are similar in hue.

However, there are limitations in reproducing certain colors and in reproducing colors that are similar in hue. Moreover, color characteristics can change depending, for example, on the medium bearing or presenting the colors; the ancillary or accessory ingredients in a composition containing a colorant, such as, a dye, a pigment or a lake pigment; the compatibility of some colorants with a manufacturing process or reagents used therein, such as, a particular ink-producing process and the reagents used therein; and so on.

Therefore, it is desirable to have red toners for use, for example, in color imaging to complement existing toners and to enable a wider and more accurate range of red colors and hues.

SUMMARY

The instant disclosure provides combinations of a red pigment and an orange pigment for producing red toner particles; compositions and devices comprising such red toner particles; and developers comprising such red toner particles, wherein the toner particles have properties matching or are similar to those for primary color, PANTONE® Red 032, or tertiary color, PANTONE® Warm Red.

In embodiments, the instant disclosure provides a red toner particle comprising at least one resin-forming molecule, such as, a polymer, such as, a resin; a red pigment, such as, one comprising a Naphthol Red, such as, a Colour Index (C.I.) Pigment Red (PR) 170 (C.I. PR 170); and an orange pigment, such as, one comprising a Pyrazolone Orange, such as, a C.I. Pigment Orange (PO) 34 (C.I. PO 34), wherein the resulting toner particles of interest have properties that match or approximate the properties of PANTONE® Red 32 or of PANTONE® Warm Red, within a human perception limit ($\Delta E_{2000}$) of about 3 units or less when presented on standard paper.

In embodiments, a toner composition of interest has a hue angle of from about 28° to about 37° when presented on standard paper.

In embodiments, a toner composition of interest has an L* value of from about 51 to about 61 when presented on standard paper.

In embodiments, a toner composition of interest can be a toner produced by an emulsion aggregation method, comprising, for example, a styrene or acrylate polymer, or a polyester.

Those and other embodiments were achieved in the development of toners of red and orange pigment combinations that are equivalent in properties to those of PANTONE® Warm Red or PANTONE® Red 032.

DETAILED DESCRIPTION

I. Introduction

The present disclosure provides toner particles, toners, developers comprising said toner particles, devices comprising said toner particles or said developers, imaging devices comprising said developers, imaging device components comprising said developers, systems which include such toner particles or developers, and so on.

In embodiments, a toner composition of the instant disclosure includes red toners suitable for use, for example, in a color image reproducing device. Thus, a red toner of interest can be included with a cyan, a magenta, a yellow and a black toner. The red toners of interest provide colors with properties matching, similar to or identical to the properties of PANTONE® Warm Red and PANTONE® Red 032. The red colorant is comprised of at least one orange pigment and at least one red pigment, where the orange pigment is absorbing in the wavelength region of about 400 to about 560 nm, partially transmissive in the wavelength region of about 530 to about 630 nm and transmissive in the region from about 580 to about 700 nm; and where the red pigment is minimally transmissive (5 to 15% reflectance) from 380 to 500 nm, absorbing (<5% reflectance) in the wavelength region of about 460 to 580 nm, partially transmissive in the wavelength region of about 560 to about 630 nm and transmissive in the region from about 600 to about 700 nm.

L*, a* and b* are the CIE (Commission Internationale de l'Eclairage) color component and characteristic measurements often used in defining a color or hue. L* defines lightness, a* corresponds to the red/green components or contribution and b* denotes the yellow/blue contribution.

In some embodiments, it may be advantageous to replace a* and b* by the chroma value, C, or the hue angle, h. The relationships among those variables can be visualized by plotting data points in three dimensions, that is, C and h rely on the polar coordinates of the a* and b* values.

An error or variability factor, such as, $\Delta E_{2000}$, which converts CIELAB color data (L*, a* and b*) for a pair of colors into a single value expressing the, "distance," between the colors, can be used as a measure of color difference or similarity. The formula for calculating $\Delta E_{2000}$ uses weighting to compensate for variation in the ability of the human eye to discriminate closely related shades within particular regions of the visible spectrum. When $\Delta E_{2000}$ of two colors is less than or equal to 3, the two colors are generally considered to be indistinguishable to the human eye. The CIE suggested use of a new color difference formula where an adjusted a* term is used to improve performance of low-chroma (gray) colors. The $\Delta E_{2000}$ also includes a hue dependent function to correct for perceived hue differences. (Color Research and Application in 2003 (Johnson & Fairchild, "A top down description of S-CIELAB and CIEDE2000," Color Res Appl, 28 425-435, 2003).

PANTONE® Warm Red and PANTONE® Red 032 are separated by 5.89 $\Delta E_{2000}$ units. Hence, while those two red colors are similar, they are distinct and the difference between the two colors is perceptible.

For the purposes of the instant disclosure, the term, "color," may refer to the representation of vectors of values which characterize all or a portion of the image intensity information. A color could be represented by red, green and blue intensities in an RGB color space or by a single luminosity in a grayscale color space. Alternatively, a color could be represented by information in, for example, various other spectral wavelength bands, for example, in the CMYK, PANTONE®, x-ray, CMY, infrared or gamma ray spectrum.

Unless otherwise indicated, all numbers expressing quantities, conditions and so forth used in the specification and claims are to be understood as being modified in all instances by the term, "about." "About," is meant to indicate a variation of no more than 20% from the stated value. Also used herein is the term, "equivalent," "similar," "essentially," "substantially," "approximating" and "matching," or grammatic variations thereof, have generally acceptable definitions or at the least, are understood to have the same meaning as, "about."

In the application, use of the singular includes the plural unless specifically stated otherwise. In the application, use of, "or," means, "and/or," unless stated otherwise. Furthermore, use of the term, "including," as well as other forms, such as, "includes," and, "included," is not limiting.

For the purposes of the instant disclosure, "toner," "developer," "toner composition," and "toner particles," can be used interchangeably, and any particular or specific use and meaning will be evident from the context of the sentence, paragraph and the like in which the word or phrase appears.

II. Toner Particles

Toner particles of interest comprise a red pigment, an orange pigment and other components used to make a toner as known in the art.

The toner components generally comprise a molecule or molecules that provide a suitable carrier function for the pigments of interest. Generally, the toner components comprise a polymer, and in the context of a pigment for use with certain imaging devices, comprise a polymer that solidifies to form a particle. A suitable polymer is a resin. A toner composition can comprise more than one resin.

The toner particle or a composition comprising same, such as, a developer, can include other optional reagents, such as, a surfactant, a wax, a shell and so on. A developer optionally can comprise insert particles, which can serve as toner particle carriers, which can comprise a resin as taught herein. The inert particles can be modified, for example, to serve a particular function. Hence, the surface thereof can be derivatized or the particles can be manufactured for a desired purpose, for example, to carry a charge or to possess a magnetic field.

A. Components

1. Resin

Toner particles of the instant disclosure can include a resin for forming a particulate containing or carrying the colorants of a toner of interest for use in certain imaging devices. Generally any suitable monomer or monomers are induced to polymerize to form a polymer or a copolymer, which may carry or entrap reagents present in a monomer solution. Suitable monomers useful in forming a resin include, but are not limited to, styrenes, acrylates, methacrylates, butadienes, isoprenes, acrylic acids, methacrylic acids, acrylonitriles, esters, diesters, diisocyanates, combinations thereof and the like. Any monomer may be used depending on the particular polymer or resin desired in a toner particle. Sytrenes and/or acrylates, for example, can be used for applications requiring gloss, and polyesters, for example, can be used for applications requiring low melting temperature.

One, two or more polymers may be used in forming a toner or toner particle. In embodiments where two or more polymers are used, the polymers may be in any suitable ratio (e.g., weight ratio) such as, for instance, with two different polymers, from about 1% (first polymer)/99% (second polymer) to about 99% (first polymer)/1% (second polymer), in embodiments from about 10% (first polymer)/90% (second polymer) to about 90% (first polymer)/10% (second polymer).

In embodiments, a suitable toner may include at least two amorphous resins, a high molecular weight resin (HMW) and a low molecular weight resin (LMW). As used herein, an HMW amorphous resin may have an Mw of from about 35,000 to about 150,000, in embodiments, from about 45,000 to about 140,000, and a LMW amorphous resin may have an Mw of from about 10,000 to about 30,000, in embodiments, from about 15,000 to about 25,000.

The polymer may be present in an amount of from about 65 to about 95% by weight, from about 75 to about 85% by weight of the toner particles (that is, toner particles exclusive of colorants and external additives) on a solids basis.

a. Acrylates

In embodiments, the resin, comprises, for example, those based on styrene acrylates, styrene butadienes and styrene methacrylates, such as, poly(styrene/alkyl acrylate), poly(styrene-1,3-diene), poly(styrene/alkyl methacrylate), poly(styrene/alkyl acrylate/acrylic acid), poly(styrene-1,3-diene/acrylic acid), poly(styrene/alkyl methacrylate/acrylic acid), poly(alkyl methacrylate/alkyl acrylate), poly(alkyl methacrylate/aryl acrylate), poly(aryl methacrylate/alkyl acrylate), poly(alkyl methacrylate/acrylic acid), poly(styrene/alkyl acrylate/acrylonitrile/acrylic acid), poly(styrene-1,3-diene/acrylonitrile/acrylic acid), poly(alkyl acrylate/acrylonitrile/acrylic acid), poly(styrene/butadiene), poly(methylstyrene/butadiene), poly(methyl methacrylate/butadiene), poly(ethyl methacrylate/butadiene), poly(propyl methacrylate/butadiene), poly(butyl methacrylate/butadiene), poly(methyl acrylate/butadiene), poly(ethyl acrylate/butadiene), poly(propyl acrylate/butadiene), poly(butyl acrylate/butadiene), poly(styrene/isoprene), poly(methylstyrene/isoprene), poly(methyl methacrylate/isoprene), poly(ethyl methacrylate/isoprene), poly(propyl methacrylate/isoprene), poly(butyl methacrylate/isoprene), poly(methyl acrylate/isoprene), poly(ethyl acrylate/isoprene), poly(propyl acrylate/isoprene), poly(butyl acrylate/isoprene), poly(styrene/propyl acrylate), poly(styrene/butyl acrylate), poly(styrene/butadiene/acrylic acid), poly(styrene/butadiene/methacrylic acid), poly(styrene/butadiene/acrylonitrile/acrylic acid), poly(styrene/butyl acrylate/acrylic acid), poly(styrene/butyl acrylate/methacrylic acid), poly(styrene/butyl acrylate/acrylonitrile), poly(styrene/butyl acrylate/acrylonitrile/acrylic acid), poly(styrene/butadiene), poly(styrene/butyl methacrylate), poly(styrene/butyl acrylate/acrylic acid), poly(styrene/butyl methacrylate/acrylic acid), poly(butyl methacrylate/butyl acrylate), poly(butyl methacrylate/acrylic acid), poly(acrylonitrile/butyl acrylate/acrylic acid) and combinations thereof. The polymers may be block, random or copolymers, see, for example, U.S. Pat. Nos. 5,462,828; 6,120,967; 7,713,668; and 7,759,039.

b. Polyester Polymers

In embodiments, the polymer may be a polyester polymer. Suitable polyester polymers include, for example, those which are sulfonated, non-sulfonated, crystalline, amorphous, combinations thereof and the like. The polyester polymers may be linear, branched, combinations thereof and the like. Polyester polymers may include those described, for example, in U.S. Pat. Nos. 6,593,049; 7,749,672; and 6,756,176, the disclosure of each of which hereby is incorporated by reference in entirety.

Suitable matrices include an amorphous polyester polymer, a crystalline polyester polymer or a mixture of an amorphous polyester polymer and a crystalline polyester polymer, for example, as described in U.S. Pat. Nos. 6,830,860; 7,754,406; and 7,781,138, the disclosure of each of which hereby is incorporated by reference in entirety.

When a mixture is used, the ratio of crystalline polyester polymer to amorphous polyester polymer can be in the range from about 1:99 to about 30:70; from about 5:95 to about 25:75; from about 5:95 to about 15:95.

i. Diol-Diacid/Diester Reactants

In embodiments, the resin may be a polyester polymer formed by reacting a diol with a diacid or diester, optionally, in the presence of a catalyst.

Suitable diols include aliphatic diols having from about 2 to about 36 carbon atoms, such as 1,2-ethanediol, 1,3-propanediol, 1,4-butanediol, 1,3-butanediol, 1,2-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene glycol, combinations thereof and the like.

The diol may be, for example, selected in an amount of from about 40 to about 60 mole %, in embodiments, from about 42 to about 55 mole %, in embodiments, from about 45 to about 53 mole % of a polyester polymer-forming reaction mixture.

Examples of diacids or diesters for preparing a polyester include oxalic acid, succinic acid, glutaric acid, adipic acid, suberic acid, azelaic acid, fumaric acid, maleic acid, dodecanedioic acid, sebacic acid, phthalic acid, isophthalic acid, itaconic acid, dodecylsuccinic acid, terephthalic acid, naphthalene-2,6-dicarboxylic acid, pimelic acid, naphthalene-2,7-dicarboxylic acid, cyclohexane dicarboxylic acid, malonic acid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, mesaconic acid, a diester or anhydride thereof, and combinations thereof.

The diacid may be used in an amount of, for example, from about 60 to about 40 mole %, in embodiments, from about 58 to about 45 mole %, in embodiments, from about 55 to about 47 mole % of a resin-forming reaction mixture.

Polycondensation catalysts which may be used in the polyester polymer reaction include tetraalkyl titanates; dialkyltin oxides, such as, dibutyltin oxide; tetraalkyltins, such as, dibutyltin dilaurate; dialkyltin oxide hydroxides, such as, butyltin oxide hydroxide; aluminum alkoxides, alkyl zinc, dialkyl zinc, zinc oxide, stannous oxide or combinations thereof. Such catalysts may be used in amounts of, for example, from about 0.01 mole % to about 5 mole % based on the amount of starting diacid or diester in the reaction mixture used to generate the polyester polymer, with a commensurate reduction in amounts of the other reactants.

ii. Crystalline Polyester Polymers

Examples of crystalline polyester polymers include polyamides, polyimides, polyolefins, polyethylenes, polybutylenes, polyisobutyrates, ethylene-propylene copolymers, ethylene-vinyl acetate copolymers, polypropylenes, mixtures thereof and so on. Crystalline polyester polymers include poly(ethylene adipate), poly(propylene adipate), poly(butylene adipate), poly(pentylene adipate), poly(hexylene adipate), poly(octylene adipate), poly(ethylene succinate), poly(propylene succinate), poly(butylene succinate), poly(pentylene succinate), poly(hexylene succinate), poly(octylene succinate), poly(ethylene sebacate), poly(propylene sebacate), poly(butylene sebacate), poly(pentylene sebacate), poly(hexylene sebacate), poly(octylene sebacate), alkali copoly(5-sulfoisophthalate)-(ethylene adipate), poly(decylene sebacate), poly(decylene decanoate), poly(ethylene decanoate), poly(ethylene dodecanoate), poly(nonylene sebacate), poly(nonylene decanoate), copoly(ethylene fumarate)-(ethylene sebacate), copoly(ethylene fumarate)-(ethylene decanoate), copoly(ethylene fumarate)-(ethylene dodecanoate) and combinations thereof. In embodiments, a suitable crystalline polyester polymer may be composed of ethylene glycol and a mixture of dodecanedioic acid and fumaric acid comonomers.

The crystalline polyester polymer can possess any of various melting points, for example, from about 30° C. to about 120° C., from about 50° C. to about 90° C. The crystalline polyester polymer may have a number average molecular weight ($M_n$), as measured, for example, by gel permeation chromatography (GPC) of, for example, from about 1,000 to about 50,000, from about 2,000 to about 25,000; and a weight average molecular weight ($M_w$) of, for example, from about 2,000 to about 100,000, from about 3,000 to about 80,000, as determined by GPC using, for example, polystyrene standards. The molecular weight distribution ($M_w/M_n$) of the crystalline polyester polymer may be, for example, from about 2 to about 6, from about 3 to about 4.

The crystalline polyester polymer may be present, for example, in an amount of from about 5 to about 50% by weight of polymer of a toner particle, from about 10 to about 35% by weight of polymer of a toner particle, see, for example, U.S. Publ. No. 20060222991.

iii. Amorphous Polyester Polymers

In embodiments, suitable amorphous polyester polymers include polyamides, polyimides, polyolefins, polyethylenes, polybutylenes, polyisobutyrates, ethylenepropylene copolymers, ethylene-vinyl acetate copolymers, polypropylenes, combinations thereof and the like. Amorphous polyester polymers also include alkali sulfonated polyester polymers, branched alkali sulfonated polyester polymers, alkali sulfonated polyimide polymers and branched alkali sulfonated polyimide polymers. Alkali sulfonated polyester polymers may be useful in embodiments, such as, the metal or alkali salts of copoly(ethylene terephthalate)-(ethylene 5-sulfoisophthalate), copoly(propylene terephthalate)-(propylene 5-sulfo-isophthalate), copoly(diethylene terephthalate)-(diethylene 5-sulfo-isophthalate), copoly(propylene diethylene terephthalate)-(propylene diethylene 5-sulfoisophthalate), copoly(propylene butylene terephthalate)-(propylene butylene 5-sulfo-isophthalate), copoly(propoxylated bisphenol A fumarate)-(propoxylated bisphenol A 5-sulfo-isophthalate), combinations thereof and so on.

In embodiments, an unsaturated, amorphous polyester polymer may be used. Examples of such polyesters include those disclosed in U.S. Pat. No. 6,063,827, the disclosure of which hereby is incorporated by reference in entirety. Exemplary unsaturated amorphous polyester polymers include, but are not limited to, poly(propoxylated bisphenol cofumarate), poly(ethoxylated bisphenol cofumarate), poly(butyloxylated bisphenol cofumarate), poly(copropoxylated bisphenol co-ethoxylated bisphenol cofumarate), poly(1,2-propylene fumarate), poly(propoxylated bisphenol comaleate), poly (ethoxylated bisphenol comaleate), poly(butyloxylated bisphenol comaleate), poly(copropoxylated bisphenol co-ethoxylated bisphenol comaleate), poly(1,2-propylene maleate), poly(propoxylated bisphenol co-itaconate), poly (ethoxylated bisphenol co-itaconate), poly(butyloxylated bisphenol co-itaconate), poly(copropoxylated bisphenol co-ethoxylated bisphenol co-itaconate), poly(1,2-propylene itaconate) and combinations thereof.

The amorphous polyester polymer may be present, for example, in an amount of from about 45 to about 5% by weight of polymer of a toner particle, in embodiments, from about 40 to about 15% by weight of polymer of a toner particle, see, for example, U.S. Publ. No. 20060222991.

2. Colorants for Warm Red and Red 032

In embodiments, toners of the instant disclosure relate to red toners that have, approximate or have about the same properties as that of PANTONE® Red 032 or PANTONE® Warm Red. Essentially, the difference of properties between a toner of interest and the properties of PANTONE® Warm Red or PANTONE® Red 032 is about 3 $\Delta E_{2000}$ units or less, 2 units or less, 1 unit or less, when the toner is presented on standard paper, which can be a commercially available white xerographic paper with a weight of about 20 lbs. and a brightness rating of about 92, such as, XEROX° Business 4200 Copy Paper.

The disclosure relates to combining a red pigment and an orange pigment. In determining the amounts of red pigment and of orange pigment to use in a toner of interest, there are different factors, considerations, relationships and that like that can be considered, depending on, for example, the nature of the substrate (e.g., smooth vs. rough), toner mass per unit area (TMA), level of gloss and the toner deposition method (e.g., xerographic vs. filtration). In embodiments, color parameters can be related with the actual pigment density (TMA×loading) which often defines the perception of and the color.

Those relationships can be observed through statistical analyses of color samples produced by blending the red and orange pigments in varying amounts and displaying the various samples using, for example, different presentation modes, such as, wet deposition or xerographic printing. In consideration of those relationships, approaches to adjust $\Delta E_{2000}$ or to obtain a desired $\Delta E_{2000}$ include modifying one or more of the factors that can influence pigment amounts to obtain a toner of interest, for example, the difference between two samples may be minimized by altering the TMA of a sample.

For the purposes of the instant disclosure, a, "red pigment," of interest is one which is minimally transmissive (about 5% to about 15% reflectance) for electromagnetic radiation of from about 380 nm to about 500 nm; is absorbing (less than about 5% reflectance) for wavelengths of from about 460 nm to about 580 nm; is partially transmissive for wavelengths of about 560 nm to about 630 nm; and is transmissive for wavelengths of about 600 nm to about 700 nm.

For the purposes of the instant disclosure, an, "orange pigment," of interest is one which is absorbing for wavelengths of from about 400 nm to about 560 nm; is partially transmissive for wavelengths of about 530 nm to about 630 nm; and is transmissive for wavelengths of about 580 nm to about 700 nm.

As a means to assess more rapidly the approximate amounts of red and orange pigments to employ, a wet deposition ('wet-dep') method can be used, for example, wherein known quantities of an aqueous suspension of toner (e.g., ~150-400 mg/L) are filtered through a nitrocellulose membrane. The filter is dried leaving a patch of deposited toner at a known TMA. The filter then is protected with Mylar and passed through a laminator to fuse the toner to the membrane, providing a smooth and glossy sample. The color sample can be read in a spectrophotometer to provide CIELAB values.

Alternatively, for example, machine prints, for example, using half toning with the red pigment and the orange pigment in separate developer housings, can be made to determine color similarities and pigment ratios. Thus, a two dimensional grid of samples using predetermined, varying amounts of each pigment per sample are applied to a substrate to form a color sample array each with a varying amount of one or both pigments, the individual samples of the array are examined, for example, determining the L*, a* and b* values for each sample, calculating an error factor for each sample relative to the values of PANTONE® Warm Red or PANTONE® Red 032, and correlating similarity based on an error or variability factor to the known ratios and amounts of red and orange pigments contained in each sample.

The instant disclosure provides two red toner formulations matching or approximating the properties of PANTONE® Warm Red and of PANTONE® Red 032 to within a $\Delta E_{2000}$ of 3 or less, where the pigments can be a Naphthol Red or a Cadmium Red and a Pyrazolone Orange. An example of a red pigment is a C.I. PR170 or a C.I. PR170.1, or equivalent thereof, and examples of orange pigments are C.I. PO 34, C.I. PO 13 or equivalents thereof. Other examples of red colorants include dyes and pigments such as C.I. Pigment Red (PR)1, C.I. Pigment Red 2, C.I. Pigment Red 3, C.I. Pigment Red 4, C.I. Pigment Red 5, C.I. Pigment Red 6, C.I. Pigment Red 7, C.I. Pigment Red 8, C.I. Pigment Red 9, C.I. Pigment Red 10, C.I. Pigment Red 11, C.I. Pigment Red 12, C.I. Pigment Red 14, C.I. Pigment Red 15, C.I. Pigment Red 16, C.I. Pigment Red 17, C.I. Pigment Red 18, C.I. Pigment Red 19, C.I. Pigment Red 21, C.I. Pigment Red 22, C.I. Pigment Red 23, C.I. Pigment Red 30, C.I. Pigment Red 31, C.I. Pigment Red 32, C.I. Pigment Red 37, C.I. Pigment Red 38, C.I. Pigment Red 40, C.I. Pigment Red 41, C.I. Pigment Red 42, C.I. Pigment Red 48(Ca), C.I. Pigment Red 48(Mn), C.I. Pigment Red 57(Ca), C.I. Pigment Red 57:1, C.I. Pigment Red 88, C.I. Pigment Red 112, C.I. Pigment Red 114, C.I. Pigment Red 122, C.I. Pigment Red 123, C.I. Pigment Red 144, C.I. Pigment Red 146, C.I. Pigment Red 149, C.I. Pigment Red 150, C.I. Pigment Red 166, C.I. Pigment Red 168, C.I. Pigment Red 170, C.I. Pigment Red 170:1, C.I. Pigment Red 171, C.I. Pigment Red 175, C.I. Pigment Red 176, C.I. Pigment Red 177, C.I. Pigment Red 178, C.I. Pigment Red 179, C.I. Pigment Red 184, C.I. Pigment Red 185, C.I. Pigment Red 187, C.I. Pigment Red 202, C.I. Pigment Red 209, C.I. Pigment Red 219, C.I. Pigment Red 224, C.I. Pigment Red 245 and combinations thereof.

The orange colorant may include colorants such as Pigment Orange (PO)1, Pigment Orange 2, Pigment Orange 5, Pigment Orange 7, Pigment Orange 13, Pigment Orange 15, Pigment Orange 16, Pigment Orange 17, Pigment Orange 19, Pigment Orange 24, Pigment Orange 34, Pigment Orange 36, Pigment Orange 38, Pigment Orange 40, Pigment Orange 43, and Pigment Orange 66 and combinations thereof.

Those pigments are lightfast, as known in the art, and which can be determined using standard materials and methods, for example, using an artificial light source, such as, a DIN ISO 12 040 (Xerotest, 1200 W) bulb, and a suitable substrate or receiving member, such as, a standard paper, and following a suitable period of exposure time, using, for example, the 8-step Blue Wool scale to determine the degree, if any, of difference between the sample exposed to light and an unexposed control; and so on.

As used herein, "lightfastness," refers to the degree to which a dye resists fading due to light exposure over time. The Blue Wool Scale measures and calibrates the permanence of coloring dyes. Traditionally that test was developed for the textile industry but now been adopted by the printing industry as a measure of lightfastness of inks. Normally, two identical samples are created. One is placed in the dark as the control and the other is placed in the equivalent of sunlight for a 3-month period. A standard blue wool textile fading test card is also placed under the same light conditions as the sample under test. The amount of fading of the sample is then assessed by comparison to the original colour. A rating between 1 and 8 is awarded by identifying which one of the eight strips on the blue wool standard card has faded to the same extent as the sample under test. Zero denotes extremely poor colour fastness whilst a rating of eight is deemed not to have altered from the original and thus is credited as being lightfast and permanent. For an ink or toner of interest, a lightfastness of about 6 or greater, about 7 or greater, about 8 or greater is desirable. In embodiments, lightfastness can be determined using devices available, for example, from Microscal Co., London, UK or Q-Lab Corp, Cleveland, Ohio.

Toners also can be evaluated for lightfastness using about 24 hour and about 72 hour Xenon-ARC, Atlas Suntest machine, Xenon lamp, 550 W/m2, BST=63° C., light exposure. Toner mass equivalent (TMA) of about 0.45 mg/cm$^2$ is uniformly deposited onto a paper substrate by wet deposition and fused using an envelope fuser. The paper patches are exposed to Xenon-ARC lamp for 72 hours. Color measurements can be done at 24 (47520 KJ/m$^2$) and 72 hours (95040 KJ/m$^2$). The color difference, $\Delta E_{2000}$, of patches before and after the light exposure is determined using, for example, a Gretag Macbeth Spectrolino device (D50 illuminate, 2° observer, no filter), with a difference of about 3 or less being acceptable.

Suitable amounts of each of the red and orange pigments in a toner can be selected by assessing the $\Delta E_{2000}$ difference of candidate toners of interest as compared to PANTONE® Warm Red or PANTONE® Red 032, using, for example, a machine or a device and a receiving medium or substrate in and for which the toner will be used. Hence, a commercially available photocopier using, for example, standard paper can be used. Then, as known in the art, a CIELAB a*-b* plot is obtained for a composition and the $\Delta E_{2000}$ value is determined using a known fitting function to reveal similarity to PANTONE® Red 032 or PANTONE® Warm Red.

Comparing L* values also provides a metric for assessing similarity of color samples to PANTONE® Warm Red or PANTONE® Red 032. For the purposes of the instant application, a toner of interest is one with an L* value of about 49 to about 63, from about 51 to about 61, from about 53 to about 60.

Hue angle also can be a suitable metric for determining similarity of a sample to PANTONE® Red 032 or PANTONE® Warm Red. Hue angle can be calculated from CIELAB data using known formulae, such as, the inverse tangent of the a* and b* values when presented in polar form, see, for example. U.S. Pat. No. 6,980,219. For the purposes of the instant application, a toner of interest has a hue angle from about 25° to about 39°, from about 27° to about 37°, from about 29° to about 35°.

Toners of the present disclosure may be applied at a TMA of from about 0.1 mg/cm$^2$ to about 1.5 mg/cm$^2$, from about 0.2 mg/cm$^2$ to about 0.7 mg/cm$^2$.

The red pigment may be present in amounts of from about 3.5% to about 4.7%, from about 3.7% to about 4.5%, from about 3.9% by solids weight to about 4.3% by solids weight of the toner formulation and the orange pigment may be present from about 0.6% to about 1.9%, from about 0.8% to about 1.7%, from about 1% by solids weight to about 1.5% by solids weight of the toner formulation.

As known in the art and as taught herein, hue, color, $\Delta E_{2000}$ value and so on can vary, depending on, for example, the receiving member, level of gloss, deposition method, TMA, whether the pigments are applied separately or premixed in a single developer and so on. Hence, the actual pigment amounts above may vary depending on such factors and can be optimized as taught herein for the intended use. Thus, for example, because TMA values can impact $\Delta E_{2000}$, toner amounts deposited can be adjusted to obtain TMA values suitable to obtain a red toner of interest.

3. Optional Components a. Surfactants

In embodiments, toner compositions may be in dispersions including surfactants. Moreover, toner particles may be formed by emulsion aggregation methods where the polymer and other components of the toner are in combination with one or more surfactants to form an emulsion.

One, two or more surfactants may be used. The surfactants may be selected from ionic surfactants and nonionic surfactants, or combinations thereof. Anionic surfactants and cationic surfactants are encompassed by the term, "ionic surfactants." In embodiments, the total amount of surfactants may be in an amount of from about 0.01% to about 5% by weight of the toner-forming composition, from about 0.75% to about 4% by weight of the toner-forming composition, from about 1% to about 3% by weight of the toner-forming composition.

Examples of nonionic surfactants include, for example, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether and dialkylphenoxy poly(ethyleneoxy) ethanol, for example, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX890™ and ANTAROX897™. Other examples of suitable nonionic surfactants include a block copolymer of polyethylene oxide and polypropylene oxide, including those commercially available as SYNPERONIC® PR/F, in embodiments, SYNPERONIC® PR/F 108; and DOWFAX, available from The Dow Chemical Corp.

Anionic surfactants include sulfates and sulfonates, such as, sodium dodecylsulfate (SDS), sodium dodecylbenzene sulfonate, sodium dodecylnaphthalene sulfate and so on; dialkyl benzenealkyl sulfates; acids, such as, palmitic acid, and NEOGEN or NEOGEN SC obtained from Daiichi Kogyo Seiyaku, and so on, combinations thereof and the like. Other suitable anionic surfactants include, in embodiments, alkyldiphenyloxide disulfonates or TAYCA POWER BN2060 from Tayca Corporation (Japan), which is a branched sodium dodecyl benzene sulfonate. Combinations of those surfactants and any of the foregoing nonionic surfactants may be used in embodiments.

Examples of cationic surfactants include, for example, alkylbenzyl dimethyl ammonium chloride, dialkyl benzene-alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, trimethyl ammonium bromides, halide salts of quarternized polyoxyethylalkylamines, dodecylbenzyl triethyl ammonium chlorides, MIRAPOL® and ALKAQUAT® available from Alkaril Chemical Company, SANISOL® (benzalkonium chloride) available from Kao Chemicals and the like, and mixtures thereof, including, for example, a nonionic surfactant as known in the art or provided hereinabove.

b. Waxes

The toners of the instant disclosure, optionally, may contain a wax, which can be either a single type of wax or a mixture of two or more different types of waxes (hereinafter identified as, "a wax"). A wax can be added to a toner formulation or to a developer formulation, for example, to improve particular toner properties, such as toner particle shape, charging, fusing characteristics, gloss, stripping, offset properties and the like. Alternatively, a combination of waxes can be added to provide multiple properties to a toner or a developer composition. A wax may be included as, for example, a fuser roll release agent.

The wax may be combined with the resin-forming composition for forming toner particles. When included, the wax may be present in an amount of, for example, from about 1 weight % to about 25 weight % of the toner particles, from about 5 weight % to about 20 weight % of the toner particles.

Waxes that may be selected include waxes having, for example, a weight average molecular weight of from about 500 to about 20,000, from about 1,000 to about 10,000. Waxes that may be used include, for example, polyolefins, such as, polyethylene, polypropylene and polybutene waxes, such as, those that are commercially available, for example, POLYWAX™ polyethylene waxes from Baker Petrolite, wax emulsions available from Michaelman, Inc. or Daniels Products Co., EPOLENE N15™ which is commercially available from Eastman Chemical Products, Inc., VISCOL 550-P™, a low weight average molecular weight polypropylene available from Sanyo Kasei K. K.; plant-based waxes, such as carnauba wax, rice wax, candelilla wax, sumac wax and jojoba oil; animal-based waxes, such as beeswax; mineral-based waxes and petroleum-based waxes, such as montan wax, ozokerite, ceresin wax, paraffin wax, microcrystalline wax and Fischer-Tropsch waxes; ester waxes obtained from higher fatty acids and higher alcohols, such as stearyl stearate and behenyl behenate; ester waxes obtained from higher fatty acids and monovalent or multivalent lower alcohols, such as butyl stearate, propyl oleate, glyceride monostearate, glyceride distearate and pentaerythritol tetrabehenate; ester waxes obtained from higher fatty acids and multivalent alcohol multimers, such as diethyleneglycol monostearate, dipropyleneglycol distearate, diglyceryl distearate and triglyceryl tetrastearate; sorbitan higher fatty acid ester waxes, such as sorbitan monostearate; cholesterol higher fatty acid ester waxes, such as, cholesteryl stearate, and so on.

Examples of functionalized waxes that may be used include, for example, amines and amides, for example, AQUA SUPERSLIP6550™ and SUPERSLIP6530™ available from Micro Powder Inc.; fluorinated waxes, for example, POLYFLUO 190™, POLYFLUO 200™, POLYSILK 19™ and POLYSILK 14™ available from Micro Powder Inc.; mixed fluorinated amide waxes, for example, MICROSPERSION 19™ also available from Micro Powder Inc.; imides, esters, quaternary amines, carboxylic acids, acrylic polymer emulsions, for example, JONCRYL 74™, 89™, 130™, 537™ and 538™ available from SC Johnson Wax; and chlorinated polypropylenes and polyethylenes available from Allied Chemical, Petrolite Corp. and SC Johnson. Mixtures and combinations of the foregoing waxes also may be used in embodiments.

c. Other Colorants

A toner particle of interest may include other colorants. Alternatively, a developer may contain not only a red toner particle of interest but also a toner particle of a different color or hue. Moreover, a color imaging device in which a red toner developer of interest can be used, will contain housings for toners of other, different colors or hues.

Hence, various known suitable colorants, such as dyes, pigments, lake pigments, mixtures of dyes, mixtures of pigments, mixtures of dyes and pigments, and the like, aside from a combination of a red pigment and an orange pigment of interest, may be included in a toner or a toner composition of interest to form other colors, or in a separate toner particle to be used in a device containing plural housings for plural toners, one of which is a red toner of interest and the others containing toners of different colors. The colorant may be included in the toner or toner composition in an amount of, for example, from about 0.1 to about 35% by weight of the toner, from about 1 to about 15 weight %, from about 3 to about 10% by weight of the toner.

Suitable colorants include those comprising carbon black, such as, REGAL 330®; magnetites, such as, Mobay magnetites, MO8029™ and MO8060™; Columbian magnetites, MAPICO® BLACK; surface-treated magnetites; Pfizer magnetites, CB4799™, CB5300™, CB5600™ and MCX6369™; Bayer magnetites, BAYFERROX8600™ and 8610™; Northern Pigments magnetites, NP-604™ and NP-608™; Magnox magnetites, TMB-100™ or TMB-104™; and the like.

Colored pigments, such as, cyan, magenta, yellow, red, green, brown, blue or mixtures thereof can be used. The additional pigment or pigments can be used as water-based pigment dispersions.

Examples of pigments include SUNSPERSE 6000, FLEXIVERSE and AQUATONE, water-based pigment dispersions from SUN Chemicals; HELIOGEN BLUE L6900™, D6840™, D7080™, D7020™, PYLAM OIL BLUE™, PYLAM OIL YELLOW™ and PIGMENT BLUE I™ available from Paul Uhlich & Company, Inc.; PIGMENT VIOLET I™, PIGMENT RED 48™, LEMON CHROME YELLOW DCC 1O26™, TOLUIDINE RED™ and BON RED C™ available from Dominion Color Corporation, Ltd., Toronto, Ontario; NOVAPERM YELLOW FGL™ and HOSTAPERM PINK E™ from Hoechst; CINQUASIA MAGENTA™ available from E.I. DuPont de Nemours & Co., and the like.

Examples of magenta pigments include 2,9-dimethyl-substituted quinacridone, an anthraquinone dye identified in the Color Index as C.I. 60710, C.I. Dispersed Red 15, a diazo dye identified in the Color Index as C.I. 26050, C.I. Solvent Red 19 and the like.

Illustrative examples of cyan pigments include copper tetra (octadecylsulfonamido) phthalocyanine, a copper phthalocyanine pigment listed in the Color Index as C.I. 74160, C.I. Pigment Blue, Pigment Blue 15:3, an Anthrazine Blue identified in the Color Index as C.I. 69810, Special Blue X-2137 and the like.

Illustrative examples of yellow pigments are diarylide yellow 3,3-dichlorobenzidene acetoacetanilide, a monoazo pigment identified in the Color Index as C.I. 12700, C.I. Solvent Yellow 16, a nitrophenyl amine sulfonamide identified in the Color Index as Foron Yellow SE/GLN, C.I. Disperse Yellow 3,2,5-dimethoxy-4-sulfonanilide phenylazo-4'-chloro-2,5-dimethoxy acetoacetanilide and Permanent Yellow FGL.

Other known colorants can be used, such as, Levanyl Black A-SF (Miles, Bayer) and Sunsperse Carbon Black LHD 9303 (Sun Chemicals), and colored dyes, such as, Neopen Blue (BASF), Sudan Blue OS (BASF), PV Fast Blue B2G 01 (American Hoechst), Sunsperse Blue BHD 6000 (Sun Chemicals), Irgalite Blue BCA (CibaGeigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), SUCD-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing and the like.

B. Toner Particle Preparation

1. Method a. Particle Formation

The toner particles may be prepared by any method within the purview of one skilled in the art, for example, any of the emulsion/aggregation methods can be used as the red and orange pigments of interest are compatible with those methods. However, any suitable method of preparing toner particles may be used, including chemical processes, such as suspension and encapsulation processes disclosed, for example, in U.S. Pat. Nos. 5,290,654 and 5,302,486, the disclosure of each of which hereby is incorporated by reference in entirety; by conventional granulation methods, such as, jet milling; pelletizing slabs of material; other mechanical processes; any process for producing nanoparticles or microparticles; and so on.

In embodiments, toner compositions may be prepared by emulsion/aggregation processes, such as, a process that includes aggregating a mixture of a resin-forming material, the pigments of interest, an optional wax and any other desired reagents in an emulsion, optionally, with surfactants as described above, and then optionally coalescing the aggregate mixture. A mixture may be prepared by adding an optional wax or other materials, which may also be optionally in a dispersion, including a surfactant, to the emulsion comprising a resin-forming material and the pigments of interest, which may be a mixture of two or more emulsions containing the requisite reagents. The pH of the resulting mixture may be adjusted with an acid, such as, for example, acetic acid, nitric acid or the like. In embodiments, the pH of the mixture may be adjusted to from about 2 to about 4.5.

Additionally, in embodiments, the mixture may be homogenized. If the mixture is homogenized, mixing can be at about 600 to about 4,000 rpm. Homogenization may be by any suitable means, including, for example, an IKA ULTRA TURRAX T50 probe homogenizer.

b. Aggregation

Following preparation of the above mixture, often, it is desirable to form larger particles or aggregates, often sized in micrometers, of the smaller particles from the initial polymerization reaction, often sized in nanometers. An aggregating agent may be added to the mixture. Suitable aggregating agents include, for example, aqueous solutions of a divalent cation, a multivalent cation or a compound comprising same.

The aggregating agent may be, for example, a polyaluminum halide, such as, polyaluminum chloride (PAC) or the corresponding bromide, fluoride or iodide; a polyaluminum silicate, such as, polyaluminum sulfosilicate (PASS); or a water soluble metal salt, including, aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate or combinations thereof.

In embodiments, the aggregating agent may be added to the mixture at a temperature that is below the glass transition temperature ($T_g$) of the resin or of a polymer.

The aggregating agent may be added to the mixture components to form a toner in an amount of, for example, from about 0.1 part per hundred (pph) to about 1 pph, in embodiments, from about 0.25 pph to about 0.75 pph.

To control aggregation of the particles, the aggregating agent may be metered into the mixture over time. For example, the agent may be added incrementally into the mixture over a period of from about 5 to about 240 minutes, from about 30 to about 200 minutes.

Addition of the aggregating agent also may be done while the mixture is maintained under stirred conditions, in embodiments, from about 50 rpm to about 1,000 rpm, from about 100 rpm to about 500 rpm; and at a temperature that is below the $T_g$ of the resin or polymer, from about 30° C. to about 90° C., in embodiments, from about 35° C. to about 70° C. The growth and shaping of the particles following addition of the aggregation agent may be accomplished under any suitable conditions.

The particles may be permitted to aggregate until a predetermined desired particle size is obtained. Particle size can be monitored during the growth process. For example, samples may be taken during the growth process and analyzed, for example, with a COULTER COUNTER®, for average particle size. The aggregation thus may proceed by maintaining the mixture, for example, at elevated temperature, or slowly raising the temperature, for example, from about 40° C. to about 100° C., and holding the mixture at that temperature for from about 0.5 hours to about 6 hours, from about hour 1 to about 5 hours, while maintaining stirring, to provide the desired aggregated particles. Once the predetermined desired particle size is attained, the growth process is halted. In embodiments, the predetermined desired particle size is within the toner particle size ranges mentioned herein.

Once the desired final size of the toner particles or aggregates is achieved, the pH of the mixture may be adjusted with base to a value of from about 6 to about 10, from about 6.2 to about 7. The adjustment of pH may be used to freeze, that is, to stop, toner particle growth. The base used to stop toner particle growth may be, for example, an alkali metal hydroxide, such as, for example, sodium hydroxide, potassium hydroxide, ammonium hydroxide, combinations thereof and the like. In embodiments, EDTA may be added to assist adjusting the pH to the desired value.

The base may be added in amounts from about 2 to about 25% by weight of the mixture, from about 4 to about 10% by weight of the mixture.

The characteristics of the toner particles may be determined by any suitable technique and apparatus. Volume average particle diameter and geometric standard deviation may be measured using an instrument, such as, a Beckman Coulter MULTISIZER® 3.

Aggregation can occur separate from coalescence. For separate aggregation and coalescence stages, the aggregation process may be conducted under shearing conditions at an elevated temperature, for example, of from about 40° C. to about 90° C., from about 45° C. to about 80° C., which may be below the $T_g$ of the resin or a polymer.

In embodiments, the aggregate particles may be of a size of less than about 5 μm, in embodiments from about 2 μm to about 3 μm, in embodiments from about 2.5 μm to about 2.9 μm.

c. Coalescence

As toner aggregates may be erose, irregular in size or irregular in shape, it may be desirable to conduct an additional step to form more regular particles. Such as process is known in the art as coalescence, see, for example, U.S. Pat. No. 7,736,831, to produce more regular, spherical particles, which can be implemented, for example, by incubating the toner particles at an elevated temperature, employing a compound to facilitate coalescence or both.

Examples of suitable coalescence agents include, but are not limited to, benzoic acid alkyl esters, ester alcohols, glycol/ether-type solvents, long chain aliphatic alcohols, aromatic alcohols, mixtures thereof and the like. Examples of benzoic acid alkyl esters include those where the alkyl group, which can be straight or branched, substituted or unsubstituted, has from about 2 to about 30 carbon atoms, such as decyl or isodecyl benzoate, nonyl or isononyl benzoate, octyl or isooctyl benzoate, 2-ethylhexyl benzoate, tridecyl or isotridecyl benzoate, 3,7-dimethyloctyl benzoate, 3,5,5-trimethylhexyl benzoate, mixtures thereof and the like. Examples of such benzoic acid alkyl esters include VELTA® 262 (isodecyl benzoate) and VELTA® 368 (2-ethylhexyl benzoate) available from Velsicol Chemical Corp. Examples of ester alcohols include hydroxyalkyl esters of alkanoic acids where the alkyl group, which can be straight or branched, substituted or unsubstituted, and can have from about 2 to about 30 carbon atoms, such as, 2,2,4-trimethylpentane-1,3-diol monoisobutyrate. An example of an ester alcohol is TEXANOL® (2,2,4-trimethylpentane-1,3-diol monoisobutyrate) available from Eastman Chemical Co. Examples of glycol/ether-type solvents include diethylene glycol monomethylether acetate, diethylene glycol monobutylether acetate, butyl carbitol acetate (BCA) and the like. Examples of long chain aliphatic alcohols include those where the alkyl group is from about 5 to about 20 carbon atoms, such as, ethylhexanol, octanol, dodecanol and the like. Examples of aromatic alcohols include benzyl alcohol and the like.

In embodiments, the coalescence agent (or coalescence agent or coalescence aid agent) evaporates during later stages of the emulsion/aggregation process, such as, during a second heating step, that is, generally above the $T_g$ of the resin or a polymer. The final toner particles are thus, free of, or essentially or substantially free of any remaining coalescence agent. To the extent that any remaining coalescence agent may be present in a final toner particle, the amount of remaining coalescence agent is such that presence thereof does not affect any properties or the performance of the toner or developer.

The coalescence agent can be added prior to the coalescence or fusing step in any desired or suitable amount. For example, the coalescence agent can be added in an amount of from about 0.01 to about 10% by weight, based on the solids content in the reaction medium, from about 0.05 or from about 0.1% to about 0.5 or to about 3.0% by weight, based on the solids content in the reaction medium. Of course, amounts outside those ranges can be used, as desired.

In embodiments, the coalescence agent can be added at any time between aggregation and coalescence, although in some embodiments it may be desirable to add the coalescence agent after aggregation is, "frozen," or completed, for example, by adjustment of pH, for example, by addition, for example, of base.

Coalescence may proceed and be accomplished over a period of from about 0.1 to about 9 hours, from about 0.5 to about 4 hours.

Following aggregation to the desired particle size, with the formation of an optional shell as described herein, the particles then may be coalesced to the desired final shape, the coalescence being achieved by, for example, heating the mixture to a temperature of from about 55° C. to about 100° C., from about 65° C. to about 75° C., which may be below the melting point of the resin or polymer(s) to prevent plasticization. Higher or lower temperatures may be used, it being understood that the temperature is a function of the polymer(s) used for the resin and/or shell.

After coalescence, the mixture may be cooled to room temperature, such as, from about 20° C. to about 25° C. The cooling may be rapid or slow, as desired. A suitable cooling method may include introducing cold water in a jacket around the reactor. After cooling, the toner particles optionally may be washed with water and then dried. Drying may be accomplished by any suitable method for drying including, for example, freeze drying.

d. Shells

In embodiments, an optional shell may be applied to the formed toner particles, aggregates or coalesced particles. Any polymer described above as suitable for the core, may be used for the shell. The shell polymer may be applied to the particles or aggregates by any method within the purview of those skilled in the art.

In embodiments, an amorphous polyester may be used to form a shell over the particles or aggregates to form toner particles or aggregates having a core-shell configuration. In embodiments, a low molecular weight amorphous polyester may be used to form a shell over the particles or aggregates.

The shell polymer may be present in an amount of from about 10% to about 32% by weight of the toner particles or aggregates, from about 24% to about 30% by weight of the toner particles or aggregates.

e. Optional Additives

In embodiments, the toner particles also may contain any or other optional additives. Hence, external additive particles including flow aid additives, which additives may be present on the surface of the toner particles, can be included with the finished developer. Examples of such additives include metal oxides, such as, titanium oxide, tin oxide, mixtures thereof and the like; colloidal silicas, such as, AEROSIL®, metal salts and metal salts of fatty acids, including zinc stearate, aluminum oxides, cerium oxides and mixtures thereof; and so on, as known in the art. Each of the external additives may be present in embodiments in amounts of from about 0.1 to about 5 weight %, from about 0.1 to about 1 weight %, of the toner. Several of the aforementioned additives are illustrated in U.S. Pat. Nos. 3,590,000, 3,800,588, and 6,214,507, the disclosures which are incorporated herein by reference.

i. Charge Additives

The toner may include any known charge additives in amounts of from about 0.1 to about 10 weight %, of from about 0.5 to about 7 weight % of the toner. Examples of such charge additives include alkyl pyridinium halides, bisulfates, the charge control additives of U.S. Pat. Nos. 3,944,493; 4,007,293; 4,079,014; 4,394,430; and 4,560,635, the disclosure of each of which hereby is incorporated by reference in entirety, negative charge enhancing additives, such as, aluminum complexes, and the like.

ii. Surface Modifications

Surface additives can be added to the toner compositions of the present disclosure, for example, after washing or drying. Examples of such surface additives include, for example, one or more of a metal salt, a metal salt of a fatty acid, a colloidal silica, a metal oxide, such as, $TiO_2$ (for example, for improved relative humidity (RH) stability, tribo control and improved development and transfer stability), an aluminum oxide, a cerium oxide, a strontium titanate, $SiO_2$, mixtures thereof and the like. Examples of such additives include those disclosed in U.S. Pat. Nos. 3,590,000; 3,720,617; 3,655,374; and 3,983,045, the disclosure of each of which hereby is incorporated by reference in entirety.

Surface additives may be present in an amount of from about 0.1 to about 10 weight %, of from about 0.5 to about 7 weight % of the toner.

Other additives include lubricants, such as, a metal salt of a fatty acid (e.g., zinc or calcium stearate) or long chain alcohols, such as, UNILIN 700 available from Baker Petrolite and AEROSIL R972® available from Degussa. The coated silicas of U.S. Pat. Nos. 6,190,815 and 6,004,714, the disclosure of each of which hereby is incorporated by reference in entirety, also can be present. The additive can be present in an amount of from about 0.05 to about 5%, from about 0.1 to about 2% of the toner, which additives can be added during the aggregation or blended into the formed toner product.

Silica, for example, can enhance toner flow, tribo control, admix control, improved development and transfer stability and higher toner blocking temperature. Zinc, calcium or magnesium stearate also can provide developer conductivity, tribo enhancement, higher toner charge and charge stability. The external surface additives can be used with or without a coating or shell.

Charge enhancing molecules can be used to impart either a positive or a negative charge on a toner particle. Examples include quaternary ammonium compounds, see, for example, U.S. Pat. No. 4,298,672, organic sulfate and sulfonate compounds, see for example, U.S. Pat. No. 4,338,390, cetyl pyridinium tetrafluoroborates, distearyl dimethyl ammonium methyl sulfate, aluminum salts and so on.

Such enhancing molecules can be present in an amount of from about 0.1 to about 10%, from about 1 to about 3% by weight.

The gloss of a toner may be influenced by the resin, such as, a polymer comprising a styrene, an acrylate or both, or the amount of retained metal ion, such as, $Al^{3+}$, in a particle. The amount of retained metal ion may be adjusted further by the addition of a chelator, such as, EDTA. In embodiments, the amount of retained catalyst, for example, $Al^{3+}$, in toner particles of the present disclosure may be from about 0.1 pph to about 1 pph, from about 0.25 pph to about 0.8 pph. The gloss level of a toner of the instant disclosure may have a gloss, as measured by Gardner gloss units (gu), of from about 20 gu to about 100 gu, from about 50 gu to about 95 gu, from about 60 gu to about 90 gu.

Hence, a particle can contain at the surface one or more silicas, one or more metal oxides, such as, a titanium oxide and a cerium oxide, a lubricant, such as, a zinc stearate. In some embodiments, a particle surface can comprise two silicas, two metal oxides, such as, titanium oxide and cerium oxide, and a lubricant, such as, a zinc stearate. All of those surface components can comprise about 5% by weight of a toner particle weight.

Toners produced in accordance with the instant disclosure and as known in the art, may possess suitable charge characteristics when exposed to extreme RH conditions. The low humidity zone (C zone) may be about 10° C. and 15% RH, while the high humidity zone (A zone) may be about 28° C. and 85% RH.

Toners of the instant disclosure also may possess a parent toner charge per mass ratio (q/m) of from about −5 μC/g to about −90 μC/g, and a final toner charge after surface additive blending of from about −15 μC/g to about −80 μC/g.

Other desirable characteristics of a toner include storage stability, particle size integrity, high rate of fusing to the substrate or receiving member, sufficient release of the image from the photoreceptor, nondocument offset, use of smaller-sized particles and so on, and such characteristics can be obtained by including suitable reagents, suitable additives or both, and/or preparing the toner with particular protocols.

The dry toner particles, exclusive of external surface additives, may have the following characteristics: (1) volume average diameter (also referred to as "volume average particle diameter") of from about 2.5 to about 20 μm, from about 2.75 to about 10 μm, from about 3 to about 7.5 μm; (2) number average geometric standard deviation (GSDn) and/or volume average geometric standard deviation (GSDv) of from about 1.18 to about 1.30, from about 1.21 to about 1.24; and (3) circularity of from about 0.9 to about 1.0 (measured with, for example, a Sysmex FPIA 2100 analyzer), from about 0.95 to about 0.985, from about 0.96 to about 0.98.

III. Developers

A. Composition

The toner particles thus formed may be formulated into a developer composition. For example, the toner particles may be mixed with carrier particles to achieve a two component developer composition. The toner concentration in the developer may be from about 1% to about 25% by weight of the total weight of the developer, from about 2% to about 15% by weight of the total weight of the developer, with the remainder of the developer composition being the carrier. However, different toner and carrier percentages may be used to achieve a developer composition with desired characteristics.

1. Carrier

Examples of carrier particles for mixing with the toner particles include those particles that are capable of triboelectrically obtaining a charge of polarity opposite to that of the toner particles. Illustrative examples of suitable carrier particles include granular zircon, granular silicon, glass, steel, nickel, ferrites, iron ferrites, silicon dioxide, one or more polymers and the like. Other carriers include those disclosed in U.S. Pat. Nos. 3,847,604; 4,937,166; and 4,935,326.

In embodiments, the carrier particles may include a core with a coating thereover, which may be formed from a polymer or a mixture of polymers that are not in close proximity thereto in the triboelectric series, such as, those as taught herein or as known in the art. The coating may include fluoropolymers, such as polyvinylidene fluorides, terpolymers of styrene, methyl methacrylates, silanes, such as triethoxy silanes, tetrafluoroethylenes, other known coatings and the like. For example, coatings containing polyvinylidenefluoride, available, for example, as KYNAR 301F™, and/or polymethylmethacrylate (PMMA), for example, having a weight average molecular weight of about 300,000 to about 350,000, such as, commercially available from Soken, may be used. In embodiments, PMMA and polyvinylidenefluoride may be mixed in proportions of from about 30 to about 70 weight % to about 70 to about 30 weight %, from about 40 to about 60 weight % to about 60 to about 40 weight %. The coating may have a coating weight of, for example, from about 0.1 to about 5% by weight of the carrier, from about 0.5 to about 2% by weight of the carrier.

Various effective suitable means can be used to apply the polymer to the surface of the carrier core, for example, cascade roll mixing, tumbling, milling, shaking, electrostatic powder cloud spraying, fluidized bed mixing, electrostatic disc processing, electrostatic curtain processing, combinations thereof and the like. The mixture of carrier core particles and polymer then may be heated to enable the polymer to melt and to fuse to the carrier core. The coated carrier particles then may be cooled and thereafter classified to a desired particle size.

The carrier particles may be prepared by mixing the carrier core with polymer in an amount from about 0.05 to about 10% by weight, from about 0.01 to about 3% by weight, based on the weight of the coated carrier particle, until adherence thereof to the carrier core is obtained, for example, by mechanical impaction and/or electrostatic attraction.

In embodiments, suitable carriers may include a steel core, for example, of from about 25 to about 100 μm in size, from about 50 to about 75 μm in size, coated with about 0.5% to about 10%, from about 0.7% to about 5% by weight of a polymer mixture including, for example, methylacrylate and carbon black, using the process described, for example, in U.S. Pat. Nos. 5,236,629 and 5,330,874.

IV. Devices Comprising a Red Toner Particle

Toners and developers can be combined with a number of devices ranging from enclosures or vessels, such as, a vial, a bottle, a flexible container, such as a bag or a package, and so on, to devices that serve more than a storage function.

A. Imaging Device Components

The toner compositions and developers of interest can be incorporated into devices dedicated, for example, to delivering same for a purpose, such as, forming an image. Hence, particularized toner delivery devices are known, see, for example, U.S. Pat. No. 7,822,370, and can contain a toner preparation or developer of interest. Such devices include cartridges, tanks, reservoirs and the like, and can be replaceable, disposable or reusable. Such a device can comprise a storage portion; a dispensing or delivery portion; and so on; along with various ports or openings to enable toner or developer addition to and removal from the device; an optional portion for monitoring amount of toner or developer in the device; formed or shaped portions to enable siting and seating of the device in, for example, an imaging device; and so on.

B. Toner or Developer Delivery Device

A toner or developer of interest may be included in a device dedicated to delivery thereof, for example, for recharging or refilling toner or developer in an imaging device component, such as, a cartridge, in need of toner or developer, see, for example, U.S. Pat. No. 7,817,944, wherein the imaging device component may be replaceable or reusable.

V. Imaging Devices

The toners or developers can be used for electrostatographic or electrophotographic processes, including those disclosed in U.S. Pat. No. 4,295,990, the disclosure of which hereby is incorporated by reference in entirety. In embodiments, any known type of image development system may be used in an image developing device, including, for example, magnetic brush development, jumping single component development, hybrid scavengeless development (HSD) and the like. Those and similar development systems are within the purview of those skilled in the art.

Imaging processes include, for example, preparing an image with an electrophotographic device including, for example, one or more of a charging component, an imaging component, a photoconductive component, a developing component, a transfer component, a fusing component and so on. The electrophotographic device may include a high speed printer, a color printer and the like.

Once the image is formed with toners/developers via a suitable image development method, such as any of the aforementioned methods, the image then may be transferred to an image receiving medium or substrate, such as, a paper and the like. In embodiments, the fusing member or component, which can be of any desired or suitable configuration, such as, a drum or roller, a belt or web, a flat surface or platen, or the like, may be used to set the toner image on the substrate. Optionally, a layer of a liquid, such as, a fuser oil can be applied to the fuser member prior to fusing.

Color printers commonly use four housings carrying different colors to generate full color images based on black plus the standard printing colors, cyan, magenta and yellow. However, in embodiments, additional housings may be desirable, including image generating devices possessing five housings, six housings or more, thereby providing the ability to carry additional toner colors to print an extended range of colors (extended gamut). For example, a five housing system could include a red toner of interest in the additional housing.

The following Examples illustrate embodiments of the instant disclosure. The Examples are intended to be illustrative only and are not intended to limit the scope of the present disclosure. Parts and percentages are by weight unless otherwise indicated. As used herein, "room temperature," (RT) refers to a temperature of from about 20° C. to about 30° C.

EXAMPLES

Example 1

Toner A is a mixture of 259.5 parts poly(styrene-co-butyl acrylate) polymer latex (42% solids), 72.0 parts polyethylene wax dispersion (31.3% solids), 60.4 parts C.I. PR 170 dispersion (15.6% solids), 45.1 parts C.I. PO 34 dispersion (16% solids) and 718.1 parts water combined at RT. A mixture of 3.6 parts poly(aluminum chloride) and 32.4 parts 0.02 N $HNO_3$ were added slowly while homogenizing at 4,000 rpm with an IKA Turrax T-50 homogenizer. The resulting mixture was stirred and heated slowly to 50° C. to aggregate the particles, at which point the particle size (as measured on a COULTER COUNTER®) was 5.24 μm. Next, 137.9 parts of a separate poly(styrene-co-butyl acrylate) polymer latex (41.4% solids) were added with continued heating. When a particle size of 5.94 μm was reached, 4.8 parts Versene 100 EDTA solution were added, the pH of the mixture was adjusted to 5.5 and the mixture temperature was increased to 95° C. Then, 200 ml of 0.1% $Cu(NO_3)_2$ solution were added and the mixture was held at 95° C. for 3.5 hours.

After cooling to room temperature, the mixture was filtered and the toner particles washed three times with water and dried. The resulting particles had a size of 5.87 μm, a GSDv/n of 1.21/1.24 and circularity of 0.96.

For wet-dep studies, a suspension of Toner A was prepared in water containing a small amount of Triton X-100 surfactant. An amount of the suspension corresponding to 4.33 mg of toner particles was passed through a nitrocellulose filter with an exposed surface area of 9.62 $cm^2$. The retained particles and filter paper were dried at room temperature, enveloped in Mylar film and passed through a GBC laminator set to 135° C.

Example 2

Toner B is a mixture of 228 parts poly(styrene-co-butyl acrylate) polymer latex (42% solids), 62 parts polyethylene wax dispersion (32% solids), 36 parts C.I. PR 170 dispersion (15.6% solids), 54 parts C.I. PO 34 dispersion (15.3% solids) and 630 parts water were combined at room temperature. A mixture of 3 parts poly(aluminum chloride) and 28 parts 0.02 N $HNO_3$ were added slowly while homogenizing at 4,000 rpm with an IKA Turrax T-50 homogenizer. The resulting mixture was stirred and heated slowly to 53° C. to aggregate the particles, at which point the particle size (as measured on a Beckman-Coulter Counter) was 5.2 μm. Then, 121 parts of a separate poly(styrene-co-butyl acrylate) polymer latex (41% solids) were added with continued heating. When a particle size of 5.9 μm was reached, 4.2 parts Versene 100 EDTA solution were added, the pH of the mixture was adjusted to 5.4 and the mixture temperature was increased to 95° C. The mixture was held at 95° C. for 80 minutes after which 125 ml of 0.1% $Cu(NO_3)_2$ solution were added and the mixture was held at 95° C. for an additional 90 minutes.

After cooling to room temperature, the mixture was filtered and the toner particles washed three times with water and dried. The resulting particles had a size of 5.8 μm, a GSDv/n of 1.19/1.20 and circularity of 0.96.

For wet-dep studies, a suspension of Toner B was prepared in water containing a small amount of Triton X-100 surfactant. An amount of the suspension corresponding to 4.32 mg of toner particles was passed through a nitrocellulose filter with an exposed surface area of 9.62 $cm^2$. The retained particles and filter paper were dried at room temperature, enveloped in Mylar film and then passed through a GBC laminator set to 135° C.

Example 3

Wet-dep preparations were used to obtain approximate amounts of red and orange pigment to obtain toners similar to PANTONE® Red 032 and PANTONE® Warm Red.

Based on the wet-dep data, toners with the relative amounts of red and orange pigments then were used in machine print comparisons. Prints of Toners A and B were generated using a XEROX® 700 photocopier under manual control. Developer was prepared at nominal toner concentration of 8% and the magenta housing position was used.

Prints were generated on Color Xpressions+ paper (CXS, 90 gsm, uncoated, P/N 3R11540, brightness 98) and Digital Color Elite Gloss coated paper (DCEG, 120 gsm, P/N 3R11450, brightness 94, gloss 76 gu) substrates with various TMA. To investigate the effect of gloss, fuser temperature was varied from 170° C. to 200° C.

TMA and CIELAB color parameters were determined for each print.

After obtaining a rough estimate of optimal TMA and fuser temperature, further experiments were conducted varying TMA in the region of interest.

The prints were assessed for CIELAB parameters and $\Delta E_{2000}$ values were obtained relative to PANTONE® Warm Red and PANTONE® Red 032. Results for minimum $\Delta E_{2000}$ calculations were:

| Print Description | L* | a* | b* | $\Delta E_{2000}$ rel. to Red 032 | $\Delta E_{2000}$ rel. to Warm Red |
|---|---|---|---|---|---|
| Toner A, CXS, TMA = 0.36 | 53.97 | 68.84 | 42.88 | 1.66 | — |
| Toner A, DCEG, TMA = 0.33 | 53.86 | 67.72 | 43.08 | 2.08 | — |
| Toner B, CXS, TMA = 0.29 | 59.07 | 63.43 | 47.25 | — | 2.03 |
| Toner B, DCEG, TMA = 0.27 | 58.64 | 62.33 | 47.76 | — | 2.61 |

As noted, under the conditions used, Toner A exhibits properties similar to that of PANTONE® Red 032 and thus can be used as a red toner for printing the PANTONE® Red 032 color on standard paper, for example, at a TMA of from about 0.33 to about 0.36. Toner B exhibits properties similar to that of PANTONE® Warm Red and thus can be used as a red toner for printing the PANTONE® Warm Red color on standard paper, for example, at a TMA from about 0.27 to about 0.29.

It will be appreciated that various of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims. Unless specifically recited in a claim, steps or components of claims should not be implied or imported from the specification or any other claims as to any particular order, number, position, size, shape, angle, color or material.

All references cited herein are herein incorporated by reference in entirety.

We claim:

1. A red toner particle, comprising:

at least one resin; and a red colorant comprising at least one orange pigment in an amount from about 0.6 to about 1.9% by solids weight of the toner formulation, and at least one red pigment in an amount from about 3.5 to about 4.7% by solids weight of the toner formulation, wherein the orange and red pigments are configured to provide a red color, wherein the orange pigment absorbs light having a wavelength of from about 400 nm to about 560 nm and comprises a Pyrazolone Orange, wherein the red pigment absorbs light having a wavelength of from about 460 nm to 580 nm and comprises a C.I. Pigment Red 170 or a C.I. Pigment Red 170.1; and wherein the toner particle comprises a red color comprising a $\Delta E_{2000}$ of 3 or less when compared to Warm Red or Red 032.

2. The toner of claim 1, wherein the at least one resin comprises a styrene, an acrylate, a methacrylate, a butadiene, an isoprene, an acrylic acid, a methacrylic acid, an acrylonitrile or combinations thereof.

3. The toner of claim 1, wherein the at least one resin comprises a polyester.

4. The toner of claim 3, wherein said polyester is amorphous or crystalline.

5. The toner of claim 3, wherein said polyester comprises an amorphous polyester and a crystalline polyester.

6. The toner of claim 1, comprising an emulsion aggregation toner.

7. The toner of claim 1, wherein said red pigment comprises a Naphthol Red which is minimally transmissive from 380 nm to about 500 nm, absorbing in the wavelength region of about 460 nm 580 nm, partially transmissive in the wavelength region of about 560 nm to about 630 nm and transmissive in the region from about 600 nm to about 700 nm.

8. The toner of claim 1, wherein said orange pigment comprises a Pyrazolone Orange which is absorbing in the wavelength region of about 400 nm to about 560 nm, partially transmissive in the wavelength region of about 530 nm to about 630 nm and transmissive in the region from about 580 to about 700 nm.

9. The toner of claim 1, comprising a hue angle from about 25° to about 390°.

10. The toner of claim 1, comprising an L* value from about 49 to about 63.

11. The toner of claim 1, wherein said red pigment comprises C.I. Pigment Red 170.

12. The toner of claim 1, wherein said orange pigment comprises C.I. Pigment Orange 34, C.I. Pigment Orange (PO) 1, C.I. Pigment Orange 2, C.I. Pigment Orange 5, C.I. Pigment Orange 7, C.I. Pigment Orange 13, C.I. Pigment Orange 15, C.I. Pigment Orange 16, C.I. Pigment Orange 17, C.I. Pigment Orange 19, C.I. Pigment Orange 24, C.I. Pigment Orange 34, C.I. Pigment Orange 36, C.I. Pigment Orange 38, C.I. Pigment Orange 40, C.I. Pigment Orange 43, and C.I. Pigment Orange 66 or combinations thereof.

13. The toner of claim 1, comprising a shell.

14. A developer comprising the toner of claim 1 and a carrier.

15. A red toner particle, comprising:

at least one resin; and a red colorant comprising a C.I. Pigment Red 170 or a C.I. Pigment Red 170.1 in an amount from about 3.5 to about 4.7% by solids weight of the toner formulation and a Pyrazolone Orange pigment in an amount from about 0.6 to about 1.9% by solids weight of the toner formulation, wherein the orange and red pigments are configured to provide a red color;

wherein the red color comprises a $\Delta E_{2000}$ of 3 or less when compared to Warm Red or Red 032 and the red color comprises a lightness L* from about 51to about 61 printed on white paper.

16. The toner of claim 15, comprising an emulsion aggregation toner.

17. The toner of claim 15, wherein said Naphthol Red pigment comprises a C.I. Pigment Red 170.

18. The toner of claim 15, wherein said Pyrazolone Orange pigment comprises a C.I. Pigment Orange.

19. The toner of claim 15, comprising an amorphous resin and a crystalline resin.

20. The toner of claims 15, comprising a low molecular weight amorphous resin and a high molecular weight amorphous resin.

* * * * *